US009236713B2

(12) United States Patent
Gfell et al.

(10) Patent No.: US 9,236,713 B2
(45) Date of Patent: Jan. 12, 2016

(54) SPARK PLUG HAVING IMPROVED GROUND ELECTRODE ORIENTATION AND METHOD OF FORMING

(71) Applicant: Federal-Mogul Ignition Company, Southfield, MI (US)

(72) Inventors: Patrick M. Gfell, Waterville, OH (US); Don R. Gregg, Weston, OH (US); Kevin J. Kowalski, Perrysburg, OH (US)

(73) Assignee: Federal-Mogul Corporation, Southfield, MI (US)

( * ) Notice: Subject to any disclaimer, the term of this patent is extended or adjusted under 35 U.S.C. 154(b) by 0 days.

(21) Appl. No.: 14/518,166

(22) Filed: Oct. 20, 2014

(65) Prior Publication Data

US 2015/0091433 A1 Apr. 2, 2015

Related U.S. Application Data

(62) Division of application No. 13/350,140, filed on Jan. 13, 2012, now Pat. No. 8,866,369.

(60) Provisional application No. 61/432,403, filed on Jan. 13, 2011.

(51) Int. Cl.

| | |
|---|---|
| ***H01T 13/08*** | (2006.01) |
| ***H01T 21/02*** | (2006.01) |
| ***H01T 13/04*** | (2006.01) |
| ***H01T 13/32*** | (2006.01) |
| ***H01T 13/38*** | (2006.01) |
| ***H01T 13/39*** | (2006.01) |

(52) U.S. Cl.

CPC ..... *H01T 13/08* (2013.01); *H01T 13/04* (2013.01); *H01T 13/32* (2013.01); *H01T 13/38* (2013.01); *H01T 13/39* (2013.01); *H01T 21/02* (2013.01)

(58) Field of Classification Search

CPC ..... H01T 13/08; H01T 21/02; H01T 13/32; H01T 13/20; H01T 13/36; H01T 13/54; B21H 3/04; F02B 2275/18; F02D 41/047; F02P 13/00

See application file for complete search history.

(56) References Cited

U.S. PATENT DOCUMENTS

| | | | |
|---|---|---|---|
| 3,077,649 | A | 2/1963 | Muniz et al. |
| 4,901,687 | A | 2/1990 | Jones |

(Continued)

FOREIGN PATENT DOCUMENTS

| | | | |
|---|---|---|---|
| CN | 101868893 | A | 10/2010 |
| EP | 1965475 | A1 | 9/2008 |

(Continued)

*Primary Examiner* — Thomas A Hollweg

(74) *Attorney, Agent, or Firm* — Robert L. Stearns; Dickinson Wright, PLLC

(57) ABSTRACT

A spark plug (20) for being threaded into a cylinder head (28) includes a shell (24) with threads (26) disposed at a predetermined angled relative to the ground electrode (34). The position of the threads (26) relative to the ground electrode (34) places the ground electrode (34) in a predetermined position in the combustion chamber (22) and relative to components of the engine, thus allowing the ground electrode (34) to provide a robust and reliable ignition. The threads (26) are formed by a thread forming apparatus (102) that includes an orientation tool (38) to position the ground electrode (34) relative to a thread forming apparatus (102), allowing the thread forming apparatus (102) to form the threads (26) at the desired angle (α).

14 Claims, 5 Drawing Sheets

(56) References Cited

U.S. PATENT DOCUMENTS

| | | | | |
|---|---|---|---|---|
| 4,989,557 | A | 2/1991 | Penney | |
| 5,091,672 | A | 2/1992 | Below | |
| 5,725,405 | A | 3/1998 | Nakatani | |
| 6,265,816 | B1 * | 7/2001 | Ito et al. | 313/141 |
| 6,489,709 | B1 | 12/2002 | Teramura et al. | |
| 6,655,334 | B2 | 12/2003 | Inagaki et al. | |
| 7,477,006 | B2 | 1/2009 | Fukuzawa et al. | |
| 2002/0158559 | A1 * | 10/2002 | Sugiyama et al. | 313/141 |
| 2003/0030355 | A1 | 2/2003 | Honda | |
| 2007/0132354 | A1 * | 6/2007 | Scott et al. | 313/141 |
| 2007/0210688 | A1 | 9/2007 | Suzuki et al. | |
| 2008/0098974 | A1 | 5/2008 | Fukuzawa et al. | |
| 2008/0203882 | A1 | 8/2008 | Kobayashi | |
| 2008/0295792 | A1 | 12/2008 | Seeger | |
| 2009/0160304 | A1 * | 6/2009 | Kameda et al. | 313/141 |
| 2010/0007261 | A1 | 1/2010 | Hartmann et al. | |
| 2010/0092255 | A1 | 4/2010 | Owusu et al. | |
| 2010/0264803 | A1 | 10/2010 | Nunome et al. | |
| 2011/0183573 | A1 | 7/2011 | Ozeki et al. | |

FOREIGN PATENT DOCUMENTS

| | | | |
|---|---|---|---|
| EP | 2063510 | A1 | 5/2009 |
| JP | 11013613 | | 1/1999 |
| JP | 2003323963 | A | 11/2003 |

* cited by examiner

SPARK PLUG HAVING IMPROVED GROUND ELECTRODE ORIENTATION AND METHOD OF FORMING

CROSS REFERENCE TO RELATED APPLICATION

This U.S. divisional application claims the benefit of U.S. application Ser. No. 13/350,140, filed Jan. 13, 2012, which claims the benefit of U.S. provisional application Ser. No. 61/432,403, filed Jan. 13, 2011, the contents of which are incorporated herein by reference in its entirety.

BACKGROUND OF THE INVENTION

1. Field of the Invention

This invention relates generally to spark plugs for internal combustion engines, and methods of forming the same.

2. Description of the Prior Art

Sparks plugs of internal combustion engines typically include a metal shell threaded into a bore of a cylinder head and extending into a combustion chamber for providing a spark to ignite a combustible mixture of fuel and air in the combustion chamber. The spark is provided between a central electrode and ground electrode, which should be properly positioned in the combustion chamber, in order to provide a reliable and robust ignition of the fuel-air mixture. Without the proper positioning, the spark may not provide a robust ignition, or may not provide any ignition of the fuel-air mixture.

SUMMARY OF THE INVENTION

One aspect of the invention provides a spark plug for being threaded into a cylinder head and extending into a combustion chamber for providing a spark to ignite a combustible mixture of fuel and air in the combustion chamber. The spark plug includes a shell formed of metal extending from a shell upper surface to a shell lower surface. A shell outer surface extends between the shell upper surface and the shell lower surface. The shell outer surface includes a plurality of threads for threading into a cylinder head. A ground electrode formed of an electrically conductive material is attached to the shell lower surface for being disposed in the combustion chamber. The threads are disposed at a predetermined angle relative to the ground electrode allowing the ground electrode to be disposed in a predetermined position in the combustion chamber when the shell is threaded into the cylinder head.

Another aspect of the invention provides a method of foil ling a spark plug for being threaded into a cylinder head and extending into a combustion chamber for providing a spark to ignite a combustible mixture of fuel and air in the combustion chamber. The method includes providing a shell formed of metal extending from a shell upper surface to a shell lower surface and including a shell outer surface between the shell upper surface and the shell lower surface; providing a ground electrode formed of an electrically conductive material; and attaching the ground electrode to the shell lower surface. The method also includes forming threads in the shell outer surface at a predetermined angled relative to the ground electrode allowing the ground electrode to be disposed in a predetermined position in the combustion chamber when the shell is threaded into the cylinder head.

When the shell is threaded into the cylinder head, the ground electrode of the spark plug is oriented in a desired position in the combustion chamber relative to the cylinder head and other components in the combustion chamber. The position of the ground electrode allows the spark plug to provide a more reliable and efficient ignition of the fuel-air mixture.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
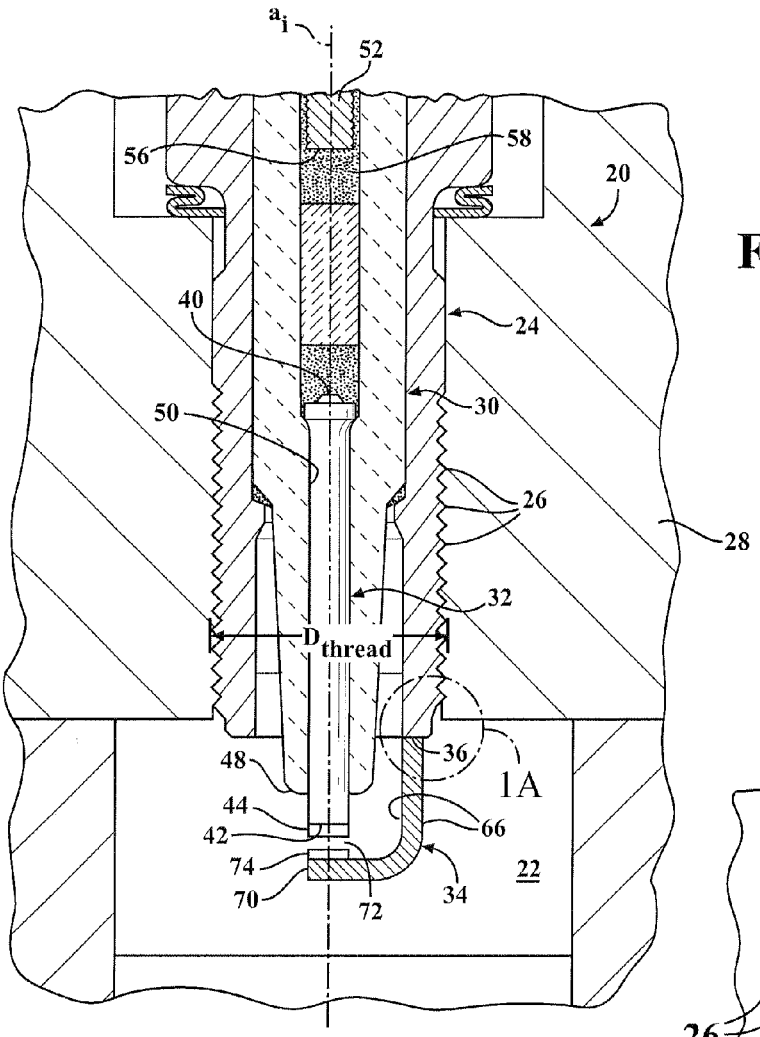
FIG. 1 is a cross sectional view of a spark plug threaded in a cylinder head according to one embodiment of the invention.

One aspect of the invention provides a spark plug 20 for providing a spark to ignite a combustible mixture of fuel and air of combustion chamber 22. The spark plug 20 includes a metal shell 24 with threads 26 attached to a component having mating threads, typically a cylinder head 28 of an internal combustion engine. The shell 24 of the spark plug 20 surrounds an insulator 30 and a central electrode 32. A ground electrode 34 is attached to a shell lower surface 36, as shown in FIG. 1. The threads 26 are formed in a predetermined location and at a predetermined angle $\alpha$ relative to the ground electrode 34. By forming the threads 26 of the shell 24 in the predetermined location relative to the ground electrode 34, the spark plug 20 can be oriented in a desired position relative to the cylinder head 28 and other components in the combustion chamber, such as the fuel injector, allowing the spark plug 20 to provide a more reliable and efficient ignition of the fuel-air mixture. Another aspect of the invention provides a method of forming the spark plug 20 using an orientation tool 38 to locate the ground electrode 34 and align the shell 24 such that the threads 26 are formed in the predetermined location relative to the ground electrode 34.

Figure 8:
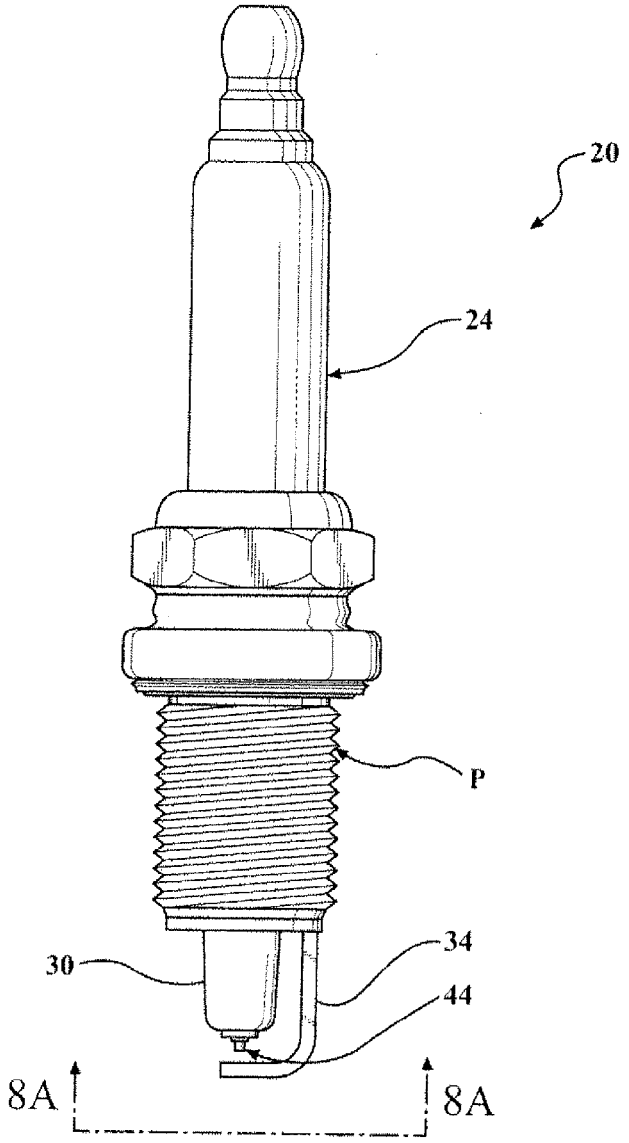
FIG. 8 is a side view of a spark plug, according to another embodiment of the invention.

The central electrode 32 is formed of an electrically conductive material extending longitudinally along an igniter central axis $a_i$ from an electrode terminal end 40 to a central firing end 42. In one embodiment, the electrically conductive material of the central electrode 32 is a nickel-based material including nickel in an amount of at least 60.0 wt. %, based on the total weight of the nickel-based material. The central electrode 32 can also include a central firing tip 44 formed of a precious metal alloy disposed on the central firing end 42, as shown in FIGS. 1 and 8, to provide the spark.

An insulator 30 formed of an electrically insulating material, such as alumina, surrounds the central electrode 32 and extends longitudinally along the igniter central axis $a_i$ from an insulator upper end (not shown) to an insulator nose end 48 such that the central firing end 42 is disposed outwardly of the insulator nose end 48. The insulator 30 includes an insulator bore 50 extending along the igniter central axis $a_i$ for receiving the central electrode 32.

The spark plug 20 also includes a terminal 52 formed of an electrically conductive material received in the insulator 30 and extending longitudinally along the igniter central axis $a_i$ from a first terminal end (not shown), which is electrically connected ultimately to a power source, to a second terminal end 56, which is electrically connected to the electrode terminal end 40. A resistor layer 58 is disposed between and electrically connects the second terminal end 56 and the electrode terminal end 40 for transmitting energy from the terminal 52 to the central electrode 32. The resistor layer 58 is formed of an electrically resistive material, such as a glass seal.

The metal shell 24, typically formed of steel, surrounds the insulator 30 and extends longitudinally along the igniter central axis $a_i$ from a shell upper surface 60 to the shell lower surface 36 such that the insulator nose end 48 extends outwardly of the shell lower surface 36, as shown in FIG. 1. In one preferred embodiment, the shell lower surface 36 is planar and presents a shell thickness $t_s$ extending perpendicular to the igniter central axis $a_i$. The shell lower surface 36 also extends annularly around the insulator 30.

The shell 24 includes a shell inner surface 62 facing the insulator 30 and a shell outer surface 64 facing opposite the shell inner surface 62. The shell inner surface 62 and shell outer surface 64 extend circumferentially around the igniter central axis $a_i$ and longitudinally between the shell upper surface 60 and the shell lower surface 36. The shell inner surface 62 presents a shell inner diameter $D_i$ and the shell outer surface 64 presents a shell outer diameter $D_o$, each extending across the igniter central axis $a_i$.

The shell outer surface 64 presents the plurality of threads 26 extending circumferentially around the igniter central axis $a_i$ between the shell upper surface 60 and the shell lower surface 36 for engaging mating threads 26 of the cylinder head 28 or another component maintaining the spark plug 20 in position in the end application. The threads 26 are formed after attaching the ground electrode 34 to the shell 24 such that the ground electrode 34 is disposed in the predetermined location relative to the threads 26 of the shell 24 and the threads 26 are disposed in the predetermined location relative to the ground electrode 34.

Figure 1A:
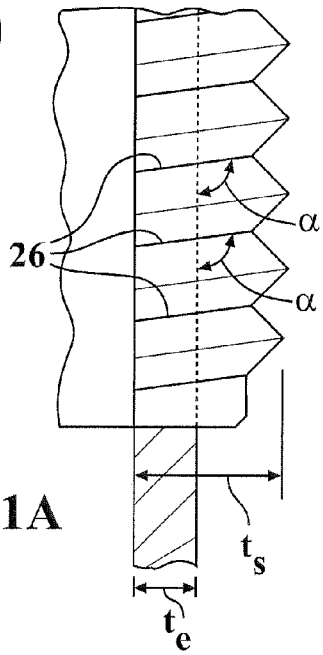
FIG. 1A is a side view of a portion of a shell including threads and an attached ground electrode with the threads disposed at a predetermined angle relative to the ground electrode according to one embodiment of the invention.
Figure 8A:
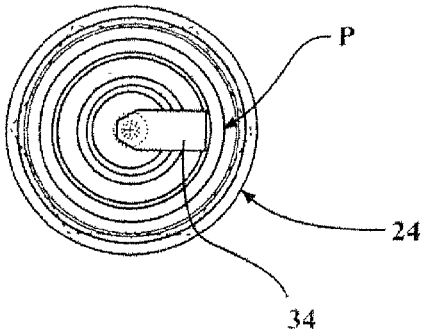
FIG. 8A is a bottom view of the spark plug of FIG. 8.

Each of the threads 26 present a thread diameter $D_{thread}$ across the igniter central axis $a_i$. The peak of each thread 26 is spaced from the peak of an adjacent thread 26. The peaks of the threads 26 are oriented in the predetermined location relative to the ground electrode 34, for example at a predetermined angle $\alpha$ relative to the side surface 66 of the ground electrode 34 adjacent the attachment surface 68, as shown in FIG. 1A. The angle $\alpha$ of the threads 26 can be determined by indexing methods. For example, the angle $\alpha$ can be determined by first locating the desired position of the shell 24 and ground electrode 34 when the spark plug 20 is disposed in the combustion chamber 22, which is typically the position providing the most effective combustion of the fuel-air mixture, and then determining an angle $\alpha$ of the threads 26 that can provide that desired position. In one embodiment, the peaks of the threads 26 are formed at an angle $\alpha$ plus or minus a certain degree from the side surface 66 of the ground electrode 34, as shown in FIG. 1A. The peaks of the threads 26 can also be formed at an angle $\alpha$ plus or minus a certain degree from a plane perpendicular to the igniter central axis $a_i$ and extending through a predetermined point P along the shell outer surface 64, for example the point P shown in the spark plug of FIGS. 8 and 8A. The threads 26 can also be formed at a predetermined distance from the attachment surface 68 of the ground electrode 34.

Figure 2:
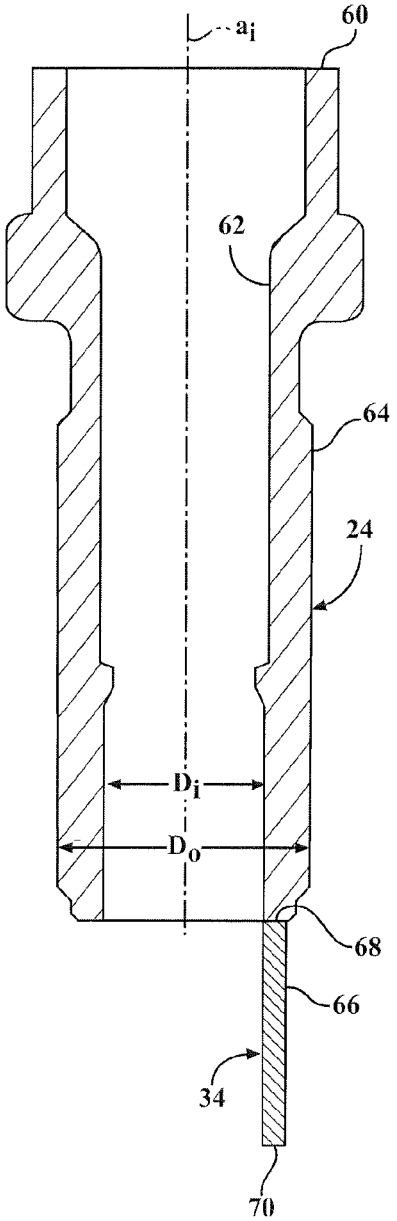
FIG. 2 is a cross-sectional view of a shell and ground electrode according to one embodiment of the invention before forming threads in the shell.

The ground electrode 34 is formed of an electrically conductive material, such as a nickel alloy, and extends from an attachment surface 68 to a ground firing surface 70 with a side surface 66 between the attachment surface 68 and the ground firing surface 70. The attachment surface 68 and firing surface are planar and present an electrode thickness $t_e$ between the side surface 66. The electrode thickness $t_e$ is typically not greater than the shell thickness $t_s$. In one embodiment, the ground electrode 34 is initially provided as extending straight from the attachment surface 68 to the ground firing surface 70, as shown in FIG. 2. The attachment surface 68 is attached to the shell lower surface 36, typically by welding. The attachment surface 68 is disposed at a predetermined circumferential location along the shell lower surface 36 relative to the threads 26.

Typically after the threads 26 are formed in the shell outer surface 64, the ground electrode 34 is bent inwardly such that the ground electrode 34 curves and the ground firing surface 70 extends past the igniter central axis $a_i$. The ground firing surface 70 is spaced from the central firing end 42, such that the side surface 66 of the ground electrode 34 and the central firing end 42 provide a spark gap 72 therebetween. However, the ground electrode 34 can comprise another design while still being disposed at a predetermined angle $\alpha$ relative to the threads 26. In one embodiment, the ground electrode 34 includes a ground firing tip 74 formed of a precious metal alloy disposed on the ground firing surface 70 for providing the spark. The ground firing tip 74 is spaced from the central firing tip 44 to provide a spark gap 72 therebetween.

Another aspect of the invention provides a method of forming the spark plug 20 including the ground electrode 34 and shell 24 disposed in the predetermined location relative to one another, so that the spark plug 20 can be oriented in a desired position relative to the cylinder head 28 and other components of the internal combustion engine, allowing the spark plug 20 to provide a more reliable and efficient or optimal combustion of the fuel-air mixture. Before forming the spark plug 20, the method includes determining a location of threads 26 to be formed in the shell outer surface 64 relative to the ground electrode 34, such that when the spark plug 20 is threaded to the cylinder head 28, the ground electrode 34 is disposed in an optimal position for ignition. In one embodiment, the threads 26 are oriented at the predetermined angle $\alpha$ relative to the side surface 66 of the ground electrode 34 adjacent the attachment surface 68, as shown in FIG. 1A. The angle $\alpha$ of the threads 26 can be determined by indexing methods.

Figure 5:
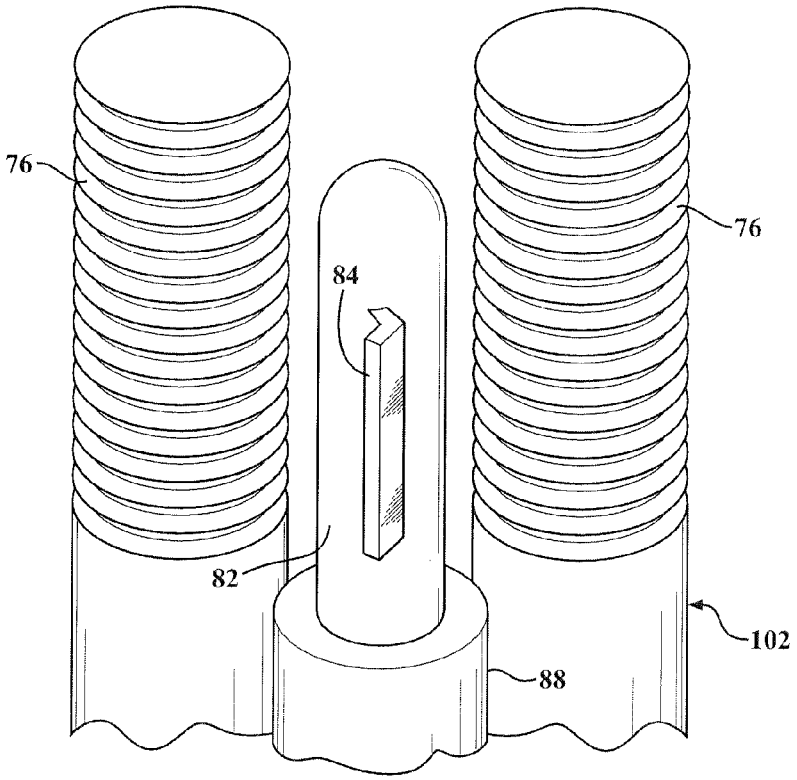
FIG. 5 is a perspective view of the orientation tool of FIG. 3 disposed in a thread forming apparatus according to one embodiment of the invention.
Figure 7:
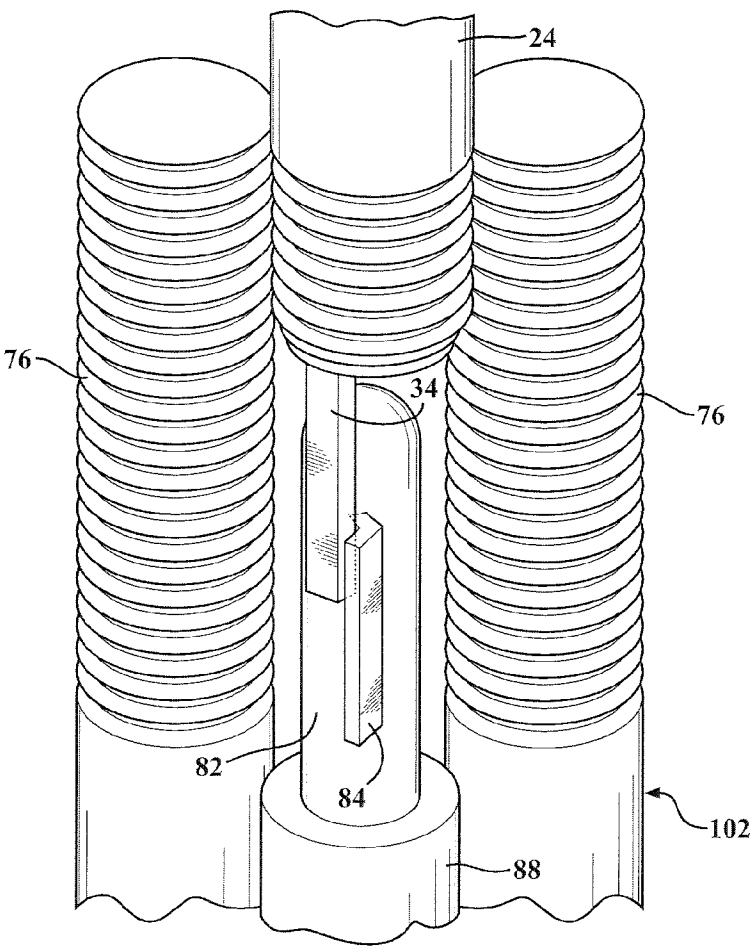
FIG. 7 is a perspective view of the shell and attached ground electrode disposed on the orientation tool of FIG. 5 after locating the ground electrode and before forming the threads.
Figure 6:
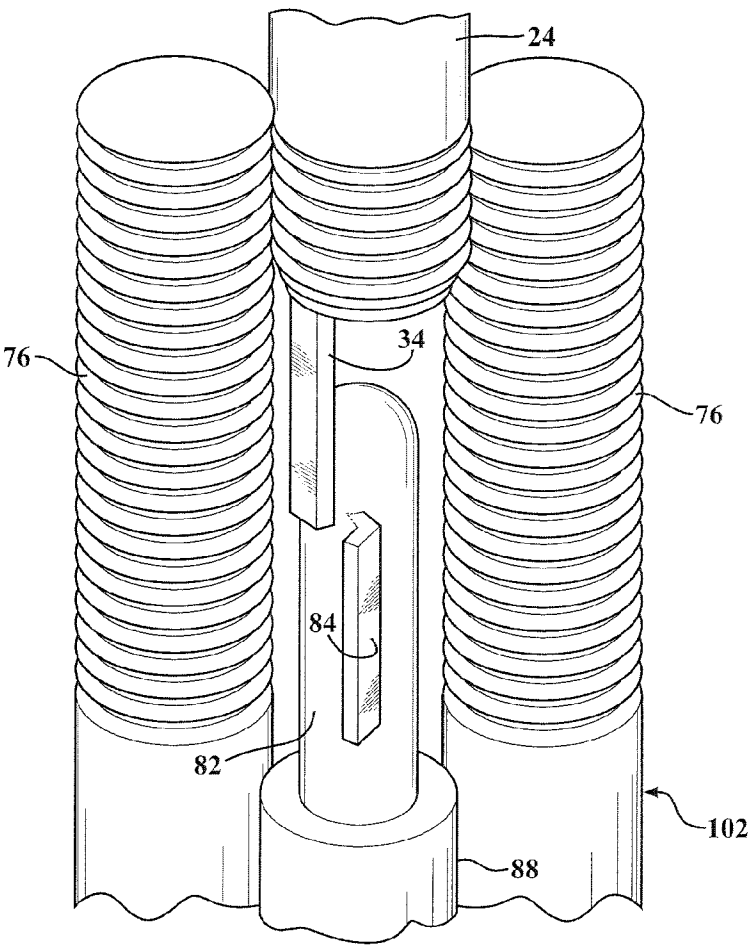
FIG. 6 is a perspective view of the shell and attached ground electrode disposed on the orientation tool of FIG. 5 before locating the ground electrode and forming the threads.

A thread forming apparatus 102 is used to form the threads 26 in the predetermined location, for example a thread roller including a plurality of thread dies 76, as shown in FIGS. 5-7. The thread forming apparatus 102 is designed to form the threads 26 in the predetermined location relative to the ground electrode 34 when the ground electrode 34 is disposed in a predetermined position relative to the thread forming apparatus 102, for example when the ground electrode 34 is disposed in a predetermined position relative to the opposing thread dies 76. The orientation tool 38 is preferably used to dispose the ground electrode 34 in the predetermined position relative to the thread forming apparatus 102.

The method of forming the spark plug 20 first includes providing the shell 24, ground electrode 34, and other components of the spark plug 20. The ground electrode 34 is initially provided as extending longitudinally and straight from the attachment surface 68 to the ground firing surface 70, as shown in FIG. 2. Before forming the threads 26 in the shell outer surface 64, the method includes attaching the attachment surface 68 of the ground electrode 34 to the shell lower surface 36 at a predetermined circumferential location along the shell lower surface 36.

Once the ground electrode 34 is attached to the shell 24, the orientation tool 38 is used to locate the ground electrode 34 and position the ground electrode 34 and the shell 24 in the thread forming apparatus 102. The orientation tool 38 may be mechanically coupled to the thread forming apparatus 102, as shown in FIGS. 5-7. Alternatively, the orientation tool 38 may be separate from the thread forming apparatus 102 and then placed along the thread forming apparatus 102 after locating the position of the ground electrode 34.

Figure 3:
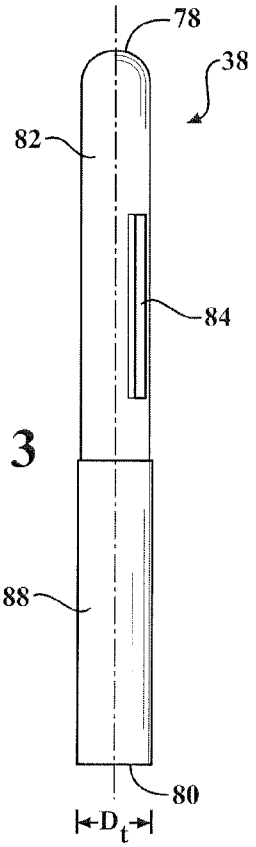
FIG. 3 is an illustration of an orientation tool according to one embodiment of the invention.

The orientation tool 38 typically extends longitudinally along a tool central axis $a_t$ from a first end 78 to a second end 80. The orientation tool 38 includes a tool outer surface 82 between the first end 78 and the second end 80 with a thread orientation feature 84 disposed in a predetermined location along the tool outer surface 82 and extending transverse to the tool outer surface 82. The orientation tool 38 presents a tool diameter $D_t$ that is no greater than the shell inner diameter $D_i$. In one embodiment, shown in FIG. 3, the orientation tool 38 includes a mandrel and the tool outer surface 82 presents a cylindrical shape. In this embodiment, the thread orientation feature 84 is a lip extending transversely from the tool outer surface 82. The mandrel is typically placed in a bore of a receptacle 88 and extends perpendicular to the thread dies 76, as shown in FIG. 5.

Figure 4:
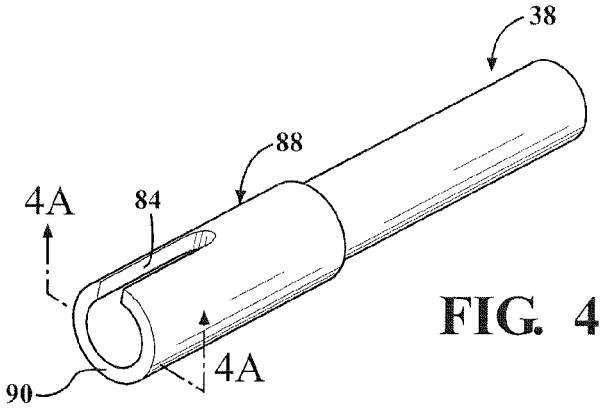
FIG. 4 is a perspective view of an orientation tool according to another embodiment of the invention.
Figure 4A:
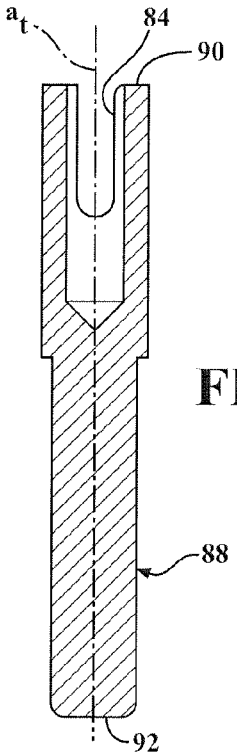
FIG. 4A is a side view of the orientation tool of FIG. 4.
Figure 4B:
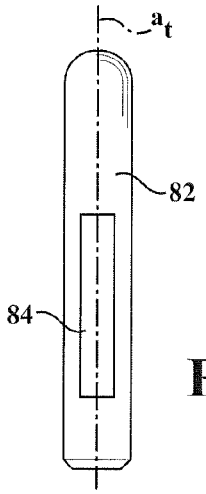
FIG. 4B is a cross sectional view of the orientation tool of FIG. 4.

In an alternate embodiment, shown in FIG. 4-4B, the orientation tool 38 includes a receptacle 88 extending longitudinally from a support surface 90 along a tool central axis $a_t$ to a base surface 92, wherein the support surface 90 is planar and extends annularly around the tool central axis $a_t$. In this embodiment, the orientation tool 38 also includes mandrel with a tool outer surface 82 that can be disposed in a bore of the receptacle 88 and presents a cylindrical shape. The mandrel presenting the tool outer surface 82 includes a flat disposed in a slot along the tool bore. The thread orientation feature 84 is provided by a surface of the slot extending from the support surface 90 toward the base surface 92 of the receptacle 88 and the flat of the mandrel. The slot surface is located in a predetermined location along the tool outer surface 82 and extends transverse to the tool outer surface 82.

The method also includes disposing the thread orientation feature 84 of the orientation tool 38 in a predetermined position relative to the thread forming apparatus 102, such that when the ground electrode 34 contacts the thread orientation feature 84 the thread forming apparatus 102 can form the threads 26 in the shell outer surface 64 in the predetermined location relative to the ground electrode 34. In the embodiment of FIGS. 5-7, the orientation tool 38 is mechanically attached to the thread forming apparatus 102. Thus, when the ground electrode 34 is maintained in contact with the thread orientation feature 84 of the orientation tool 38, the ground electrode 34 will be disposed in a predetermined position relative to the thread forming apparatus 102, allowing the thread forming apparatus 102 to form the threads 26 in the shell outer surface 64 in the desired location relative to the ground electrode 34. In another embodiment, the orientation tool 38 is separate from the thread forming apparatus 102, and the orientation tool 38 is transferred to the thread forming apparatus 102 with the shell 24 and ground electrode 34 maintained along the thread orientation feature 84.

To dispose the ground electrode 34 in the desired position, the method includes aligning the tool central axis $a_t$ of the orientation tool 38 with the igniter central axis $a_i$ of the shell 24 and disposing the shell 24 on the first end 78 of the orientation tool 38 such that the ground electrode 34 engages the tool outer surface 82, as shown in FIG. 6. In the alternate embodiment using the orientation tool 38 of FIG. 4, the ground firing surface 70 of the ground electrode 34 is disposed on the support surface 90 of the receptacle 88.

Once the shell 24 is disposed on the orientation tool 38, the method includes locating the ground electrode 34 by rotating the shell 24 relative to the orientation tool 38 such that the ground firing surface 70 slides along the tool outer surface 82 circumferentially around the central axes $a_i$, $a_t$ until the side surface 66 of the ground electrode 34 contacts the thread orientation feature 84 and is disposed in a predetermined position relative to the thread orientation feature 84, as shown in FIG. 7. In the alternate embodiment using the orientation tool 38 of FIG. 4, the ground firing surface 70 slides along the support surface 90 of the receptacle 88 until sliding into the slot and engaging the thread orientation feature 84, which is the slot surface.

Once the ground electrode 34 is positioned correctly in the thread forming apparatus 102, the method includes forming the threads 26 in the shell outer surface 64 in the predetermined location relative to the ground electrode 34, for example using the thread dies 76. The side surface 66 of the ground electrode 34 is maintained in contact with the thread orientation feature 84 until the thread forming apparatus 102 begins to form the threads 26 in the shell 24. Next, the method includes forming the threads 26 in the shell 34 at the predetermined angle $\alpha$ relative to the ground electrode 34. The thread forming apparatus 102 is programmed to form the threads 26 at the predetermined angle $\alpha$.

The method next includes disengaging the threaded shell 24 and ground electrode 34 from the orientation tool 38, and proceeding to form the remainder of the spark plug 20. In one embodiment, the further steps include bending the ground firing surface 70 of the ground electrode 34 inwardly toward the igniter central axis $a_i$, sliding the insulator 30 into the shell 24, sliding the central electrode 32 into the insulator 30, disposing the resistor layer 58 in the insulator 30 along the central electrode 32, and disposing the terminal 52 in the insulator 30 on the resistor layer 58.

After forming the spark plug 20, the method includes threading the spark plug 20 into the cylinder head 28 or another component maintaining the spark plug 20 in position during the end application. The cylinder head 28 includes threads 26 mating the threads 26 of the shell 24. The method includes engaging the threads 26 of the shell 24 and the threads 26 of the cylinder head 28, and rotating the shell 24 relative to the cylinder head 28 to screw the shell 24 into the cylinder head 28. When the shell 24 is threaded into the cylinder head 28, the ground electrode 34 will be disposed in the predetermined location relative to the threads 26 of the shell 24 and thus in an optimal location relative to the cylinder head 28, fuel injector, and other components of the combustion chamber of the internal combustion engine, allowing the spark plug 20 to provide a more reliable and efficient ignition of the fuel-air mixture in the combustion chamber 22.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A spark plug for being threaded into a cylinder head and extending into a combustion chamber for providing a spark to ignite a combustible mixture of fuel and air in the combustion chamber, comprising:

a central electrode formed of an electrically conductive material extending longitudinally along an igniter central axis from an electrode terminal end to an central firing end, an insulator formed of an electrically insulating material surrounding said central electrode and extending longitudinally along said igniter central axis to an insulator nose end such that said central firing end is disposed outwardly of said insulator nose end, said insulator including an insulator bore extending along said igniter central axis for receiving said central electrode, a shell formed of metal material surrounding said insulator and extending longitudinally along said igniter central axis from a shell upper surface to a shell lower surface such that said insulator nose end extends outwardly of said shell lower surface, said shell lower surface being planar and perpendicular to said igniter central axis and extending annularly around said insulator, said shell lower surface presenting a shell thickness, said shell including a shell inner surface facing said insulator and a shell outer surface facing opposite said shell inner surface each extending circumferentially around said igniter center axis and longitudinally between said shell upper surface and said shell lower surface, said shell inner surface presenting a shell inner diameter and said shell outer surface presenting a shell outer diameter each extending across said igniter central axis, a ground electrode formed of the electrically conductive material extending and curving from an attachment surface disposed on said shell lower surface to a ground firing surface spaced from said central firing end, said ground electrode including a side surface extending between said attachment surface and said ground firing surface, said attachment surface and said ground firing surface being planar and presenting an electrode thickness not greater than said shell thickness, said attachment surface of said ground electrode being attached to said shell lower surface, said attachment surface of said ground electrode being disposed at a predetermined circumferential location along said shell lower surface, said ground firing tip being spaced from said central firing tip to provide a spark gap therebetween, said shell outer surface presenting a plurality of threads extending circumferentially around said igniter central axis between said shell upper surface and said shell lower surface for engaging mating threads of the cylinder head, each of said threads being spaced from an adjacent thread, said threads being disposed at a predetermined angle relative to said side surface of said ground electrode adjacent said attachment surface allowing said ground electrode to be disposed in a predetermined position in the combustion chamber when said shell is threaded into the cylinder head, said threads being disposed at an angle of plus or minus a certain degree from a plane perpendicular to said igniter central axis and extending through a predetermined point along said shell outer surface; and wherein said spark plug is formed by a process comprising the steps of:

determining said predetermined location of said threads to be formed in said shell outer surface relative to said ground electrode, providing a thread forming apparatus for forming said threads in said predetermined location relative to said ground electrode when said ground electrode is disposed in a predetermined position relative to said thread forming apparatus, using an orientation tool to dispose said ground electrode in said predetermined position relative to said thread forming apparatus, wherein said orientation tool includes a tool outer surface extending longitudinally along a tool central axis from a first end to a second end and includes a thread orientation feature extending transverse to said tool outer surface, and the step of using said orientation tool including disposing said orientation tool in a predetermined location relative to said thread forming apparatus such that when said ground electrode contacts said thread orientation feature said ground electrode is disposed in said predetermined position relative to said thread forming apparatus, aligning said igniter central axis of said shell with said tool central axis, disposing said ground electrode along said tool outer surface, rotating said shell relative to said orientation tool until said ground electrode contacts said thread orientation feature, and forming said threads in said shell outer surface by said thread forming apparatus while said ground electrode contacts said thread orientation feature.

2. The spark plug of claim 1 wherein each of said threads of said shell presents a thread diameter across said igniter central axis of 10 to 18 mm.

3. The spark plug of claim 1 wherein said attachment surface of said ground electrode is planar and welded to said shell lower surface.

4. The spark plug of claim 1 wherein said electrically conductive material of said central electrode is a nickel-based material including nickel in an amount of at least 60.0 wt. %, based on the total weight of said nickel-based material.

5. The spark plug of claim 1 wherein said electrically conductive material of said central electrode is a nickel-based material including nickel in an amount of at least 60.0 wt. %, based on the total weight of said nickel-based material.

6. The spark plug of claim 1 wherein said electrically insulating material of said insulator includes alumina.

7. The spark plug of claim 1 wherein said metal material of said shell includes steel.

8. The spark plug of claim 1 wherein said electrically conductive material of said ground electrode is a nickel-based material including nickel in an amount of at least 60.0 wt. %, based on the total weight of said nickel-based material.

9. The spark plug of claim 1 wherein said ground electrode includes a ground firing tip formed of a precious metal alloy disposed on said ground firing surface for providing said spark.

10. The spark plug of claim 1 including a terminal formed of an electrically conductive material received in said insulator and extending longitudinally along said igniter central axis to a second terminal end electrically connected to said electrode terminal end.

11. The spark plug of claim 10 including a resistor layer disposed between and electrically connecting said second terminal end and said electrode terminal end for transmitting energy from said terminal to said central electrode.

12. The spark plug of claim 11 wherein said resistor layer is formed of an electrically resistive material.

13. The spark plug of claim 12 wherein said electrically resistive material is a glass seal.

14. The spark plug of claim 1 wherein said electrically conductive material of said central electrode is a nickel-based material including nickel in an amount of at least 60.0 wt. %, based on the total weight of said nickel-based material, said central electrode includes a central firing tip formed of a precious metal alloy and disposed on said central firing end for providing the spark, said electrically insulating material of said insulator includes alumina, said metal material of said shell includes steel, said attachment surface of said ground electrode is planar and welded to said shell lower surface, said electrically conductive material of said ground electrode is a nickel-based material including nickel in an amount of at least 60.0 wt. %, based on the total weight of said nickel-based material, said ground electrode includes a ground firing tip formed of a precious metal alloy disposed on said ground firing surface for providing said spark, each of said threads of said shell presents a thread diameter across said igniter central axis of 10 to 18 mm, and wherein said spark plug further comprises:

a terminal formed of an electrically conductive material received in said insulator and extending longitudinally along said igniter central axis to a second terminal end electrically connected to said electrode terminal end, a resistor layer disposed between and electrically connecting said second terminal end and said electrode terminal end for transmitting energy from said terminal to said central electrode, said resistor layer being formed of an electrically resistive material, and said electrically resistive material being a glass seal.

* * * * *

UNITED STATES PATENT AND TRADEMARK OFFICE

CERTIFICATE OF CORRECTION

PATENT NO. : 9,236,713 B2
APPLICATION NO. : 14/518166
DATED : January 12, 2016
INVENTOR(S) : Patrick M. Gfell et al.

It is certified that error appears in the above-identified patent and that said Letters Patent is hereby corrected as shown below:

In the Specification:

In column 1, lines 49-50, please change “foil ing” to --forming--.

Signed and Sealed this
Twenty-eighth Day of June, 2016

Michelle K. Lee

Michelle K. Lee
*Director of the United States Patent and Trademark Office*